US007555971B2

(12) United States Patent
Sosnowski

(10) Patent No.: US 7,555,971 B2
(45) Date of Patent: Jul. 7, 2009

(54) SELF-CONTAINED HYDRAULICALLY OPERATED TOOL

(76) Inventor: Michael Sosnowski, 17 Collins St., Salem, MA (US) 01970

( * ) Notice: Subject to any disclaimer, the term of this patent is extended or adjusted under 35 U.S.C. 154(b) by 0 days.

(21) Appl. No.: 11/949,835

(22) Filed: Dec. 4, 2007

(65) Prior Publication Data

US 2009/0139376 A1 Jun. 4, 2009

(51) Int. Cl.
*B25B 13/00* (2006.01)

(52) U.S. Cl. ..... 81/57.44; 81/58.1

(58) Field of Classification Search ..... 81/57.44, 81/58, 58.1; 173/168, 169, 218
See application file for complete search history.

(56) References Cited

U.S. PATENT DOCUMENTS 841,047 A * 1/1907 Rawdon ..... 81/57.44
2,182,663 A * 12/1939 Eby et al. ..... 29/517
2,702,489 A * 2/1955 Wallace, Sr. ..... 81/58.1
2,708,345 A * 5/1955 Miles ..... 60/493
2,723,580 A 11/1955 Brame
2,983,172 A 5/1961 Rasmussen et al.
3,326,304 A * 6/1967 Johnson ..... 173/169
3,350,985 A * 11/1967 Ackley ..... 418/206.7
4,036,311 A * 7/1977 Goof ..... 173/169
4,303,393 A * 12/1981 Gentry ..... 433/130
4,325,274 A 4/1982 Martelee
4,689,957 A * 9/1987 Gallentine ..... 60/481
5,024,142 A * 6/1991 Vrhel et al. ..... 91/271
5,377,565 A * 1/1995 Mangum ..... 81/57.33
6,702,038 B1 * 3/2004 Sedlacek et al. ..... 173/218

FOREIGN PATENT DOCUMENTS

DE 41 36 350 A1 5/1993

* cited by examiner

*Primary Examiner*—David B Thomas
(74) *Attorney, Agent, or Firm*—Burns & Levinson, LLP; Jacob N. Erlich, Esq.; Yakov Korkhin

(57) ABSTRACT

A compact, hydraulically operated tool for use in hard-to-reach or compact spaces.

9 Claims, 4 Drawing Sheets

SELF-CONTAINED HYDRAULICALLY OPERATED TOOL

BACKGROUND

This invention relates generally to power-driven tools and, more particularly, to compact power-driven tools, such as socket wrenches, screw drivers and/or drills.

Many industries rely on the use of fasteners (for example, bolts, nuts and machine screws) to secure parts together. Some common tools used in securing and loosening such fasteners are socket wrenches, screw drivers and drills.

Certain socket wrenches, screw drivers and drills are operated through the use of a lever arm which is rotated in an arc to apply torque to a tool bit applied to the fastener being secured or loosened. Such lever arms require not only room to swing the arc, but room for the operator's hand and arm. In many circumstances, sufficient working room is difficult for the operator to find. Furthermore, as newer technology makes compact design more common and desirable, it has become even more awkward for an operator to use such tools in diminished spaces.

Another difficulty of using socket wrenches, screw drivers or drills to secure and loosen fasteners is the high torque load often needed to apply to the tool bit. Achieving a high torque load requires muscular effort, which may also be difficult to accomplish in small spaces.

Previous inventions have reduced the amount of muscular effort needed to operate a tool by attaching an external power source to the tool to provide the necessary torque. However, these inventions require that the operator have the power source (such as an electrical outlet, generator, battery or compressed air) readily available. Other inventions have used a hydraulic motor to power the tool, but here such hydraulically-operated tools are often too large and cumbersome to use effectively.

It would therefore be useful if an operator of a power-driven tool, such as a socket wrench, screw driver or drill, was able to apply a high torque-load to tool bit without the need of a separate power source, in which the tool assembly portion of the tool was small enough to be used in close quarters.

SUMMARY

The present invention is a compact, hydraulically operated tool in which a high torque-load is provided to a tool bit by means of a self-contained hydraulic actuating mechanism directly attached to a tool assembly to form a compact tool easily used by an operator. The hydraulically operated tool of this invention is especially useful in hard-to-reach or compact spaces.

Several embodiments of the hydraulically operated tool are described below. However, those of skill in the art will appreciate that many other configurations may be utilized other than those described.

BRIEF DESCRIPTION OF THE FIGURES

For a better understanding of the present invention, reference is made to the accompanying detailed description and figures, wherein.

DETAILED DESCRIPTION OF PREFERRED EMBODIMENTS

Figure 1:
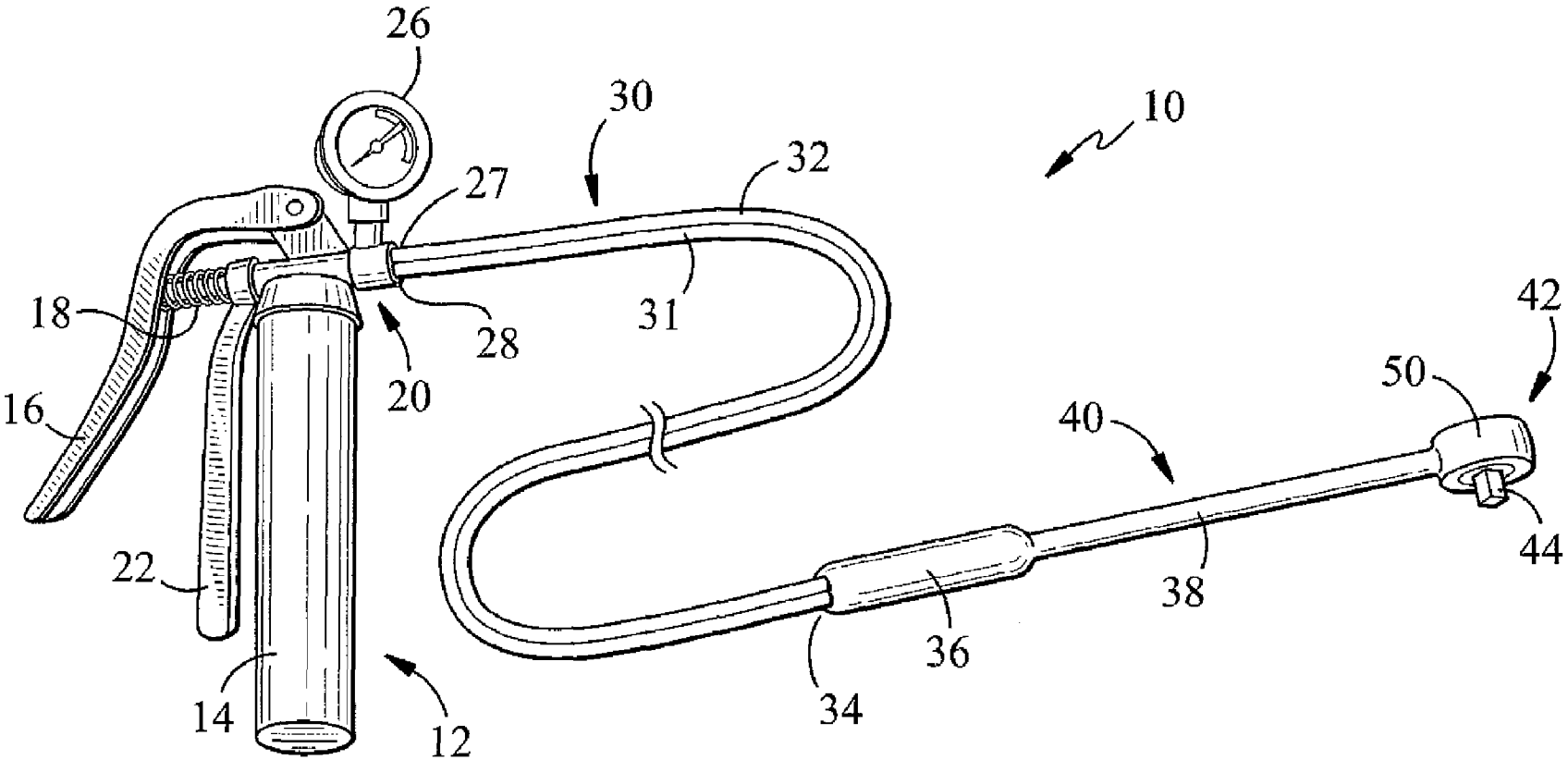
FIG. 1 is a pictorial representation of one embodiment of the hydraulically operated tool in accordance with the present invention.

Referring now to FIG. 1, a self-contained hydraulically operated tool produced in accordance with one embodiment of the present invention is shown and indicated generally by the numeral 10. The hydraulically operated tool 10 includes a hydraulic actuating mechanism 12 flexibly attached to a tool assembly 40, although it may also be possible to rigidly attach the actuating mechanism 12 to the tool assembly 40. The actuating mechanism 12 is made up of a hydraulic fluid reservoir tank 14, to which a pump assembly 20 is attached. The pump assembly 20 may be in the form of a pistol-grip hand-powered pump, although other configurations are also feasible, such as a push-button actuator or the like. Alternatively, the pump assembly 20 could be a battery-driven pump. The pump assembly 20 includes a pump handle 16, a biasing member 18 (such as a spring) to return the handle 16 to its initial position fixed to a rigid member 22 (such as a hand grip), and a supply and return line connector 30 between the pump assembly 20 and the tool assembly 40. In one embodiment of the pump assembly 20, a pressure gauge 26 is connected to the pump assembly 20 at a gauge connection point 27. The line 30 may be made up of a hydraulic supply line 31 and a hydraulic return line 32, which preferably are mounted side by side, attached at one end to a connector 28 and at another end to a line connection point 34 of a handle 36 of the tool assembly 40. The hydraulic supply line 31 and the hydraulic return line 32 may be standard high-pressure hydraulic hoses normally seen throughout the industry. Alternatively, they can be one of a variety of armor-clad hoses covered in braided steel jackets. Typically, the supply line 31 and the return line 32 are 24-48 inches in length, but other lengths may be used within the scope of this invention. The tool assembly 40 includes a handle 36 connected to a rod 38, which in turn is connected to a tool driving element 42. The handle 36 and the rod 38 may receive the line 30 or may have separate hollow vias therein. The tool driving element 42 is designed to rotate a driven socket stud 44, or other bit attachment, while remaining stationary itself. The socket stud 44 is produced in common sizes typically found in the industry, for example, ¼ inch, ⅜ inch, ½ inch and ¾ inch drives, and so forth. In one embodiment, the tool driving element 42 contains a reversing selector valve 50 shown more clearly in FIGS. 3 and 4, or dual studs as shown in FIG. 5

Figure 2:
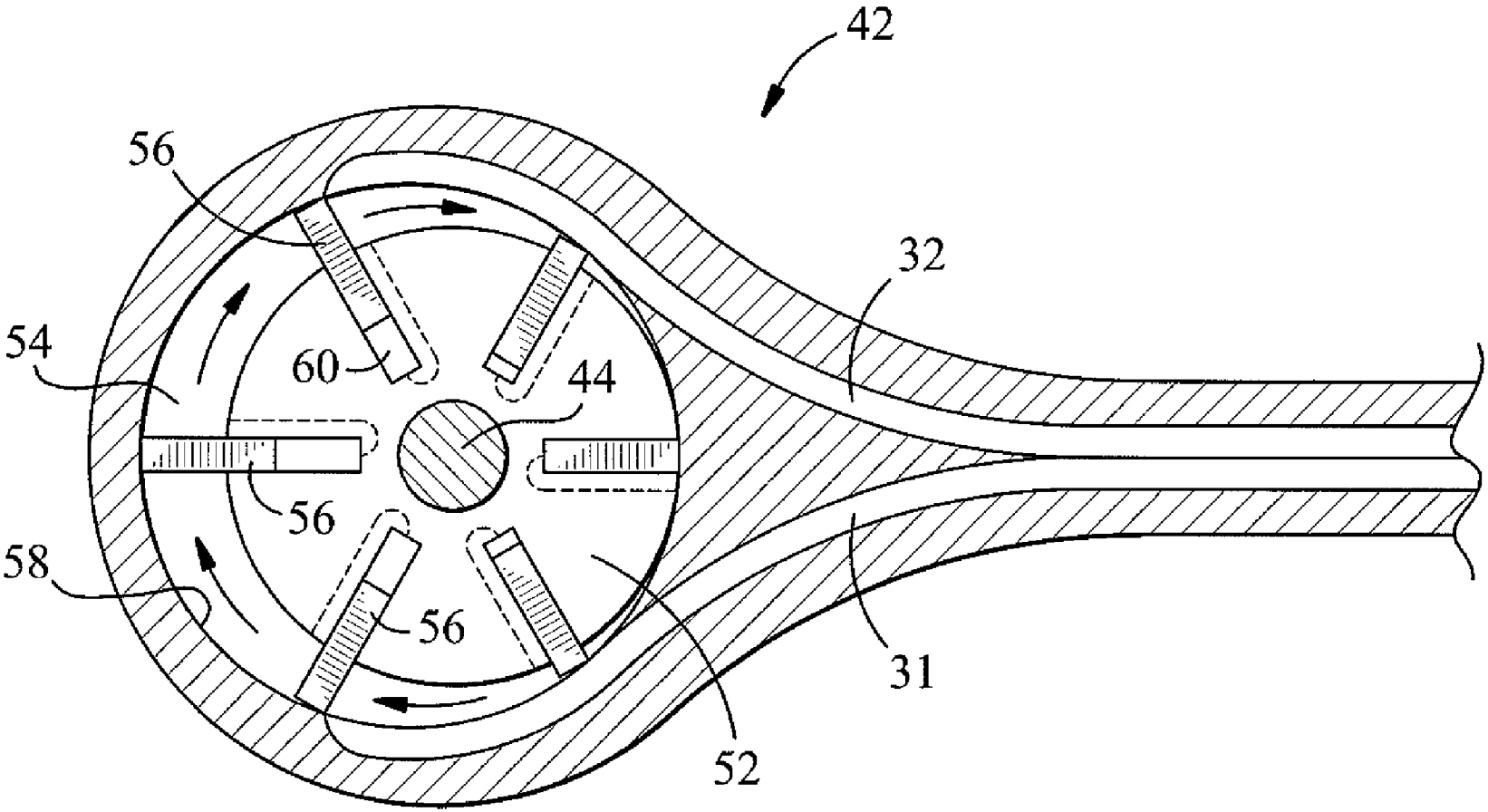
FIG. 2 is a cut-away cross-sectional representation of the tool driving element of the hydraulically operated tool in accordance with an embodiment of the present invention.
Figure 3:
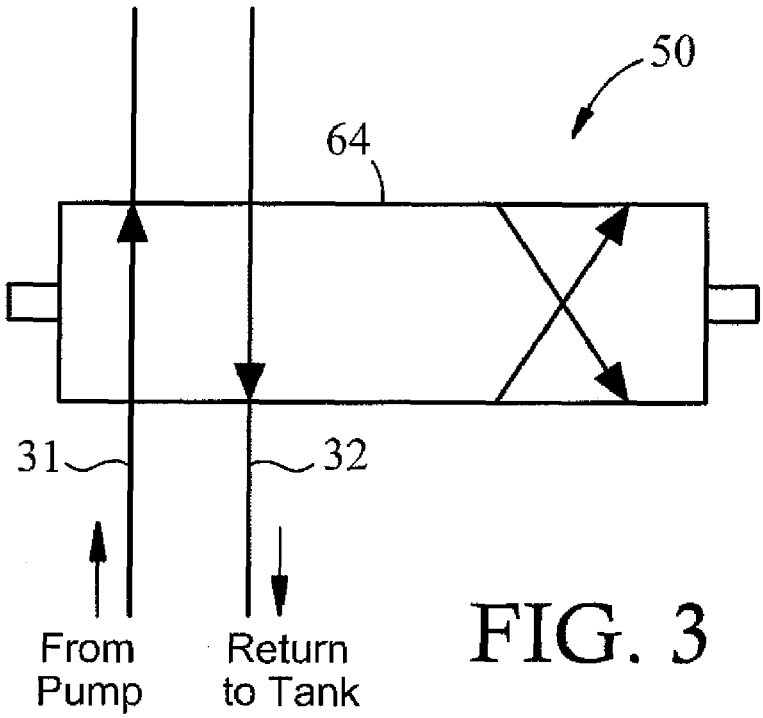
FIGS. 3 and 4 are schematic representations of a reversing valve used within an embodiment of the tool in accordance with the present invention.
Figure 4:
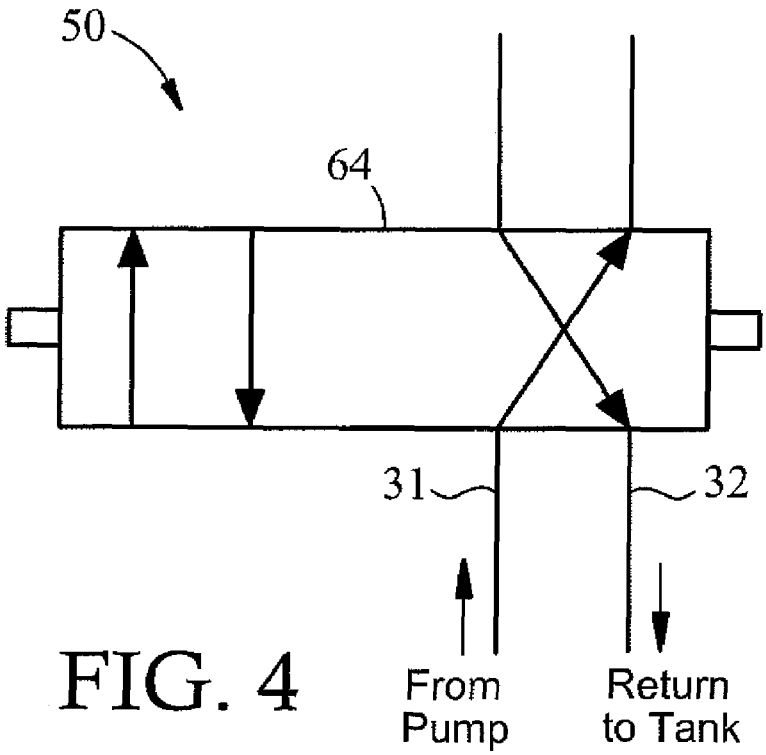

One embodiment of the tool driving element 42 is shown in FIG. 2. When the pump handle 16 is compressed by an operator, the hydraulic fluid contained in the reservoir tank 14 enters a rotary vane-type output assembly 52 by means of the hydraulic supply line 31. The hydraulic fluid then exits the rotary vane-type output shaft by means of the hydraulic return line 32 and returns to the reservoir tank 14. The movement of the hydraulic fluid through a fluid arc 54 drives socket stud 44 or other attachment secured thereto. As the hydraulic fluid strikes a series of biased vanes 56 which are forced against an outer circumference 58 of tool driving element 42, the vanes cause rotation of the stud 44. Since the outer circumference 58 is asymmetrical, the vanes recess back within grooves 60 to allow hydraulic fluid to pass back through return line 32. Depending upon the direction of the flow of hydraulic fluid, the supply line 31 and return line 32 become interchangeable, permitting the socket stud 44 to rotate in either a clockwise or counter-clockwise direction. A solenoid-operated reversing selector valve 50 shown in FIGS. 3 and 4 controls the direction of the flow, although other valves can also be used The reversing selector valve 50 in a housing (not shown) is depicted in FIGS. 3 and 4. The reversing selector valve 50 can be located at any point in the path traveled by the hydraulic fluid to the tool driving element 42. The reversing selector valve 50 includes a solenoid actuated valve 64. In order to drive the socket stud 44 or other attachment in one direction, the hydraulic fluid travels through the valve 64 by means of the hydraulic supply line 31 in a straight path, and returns through the valve 64 by means of the hydraulic return line 32, also in a straight path, as shown in FIG. 3. To reverse direction, the operator activates the solenoid and valve 64, moving the position as shown in FIG. 3 to that shown in FIG. 4, so that the hydraulic fluid travels and returns through the solenoid 64 in a criss-crossing path, as shown in FIG. 4, reversing the direction of the socket stud 44.

Figure 5:
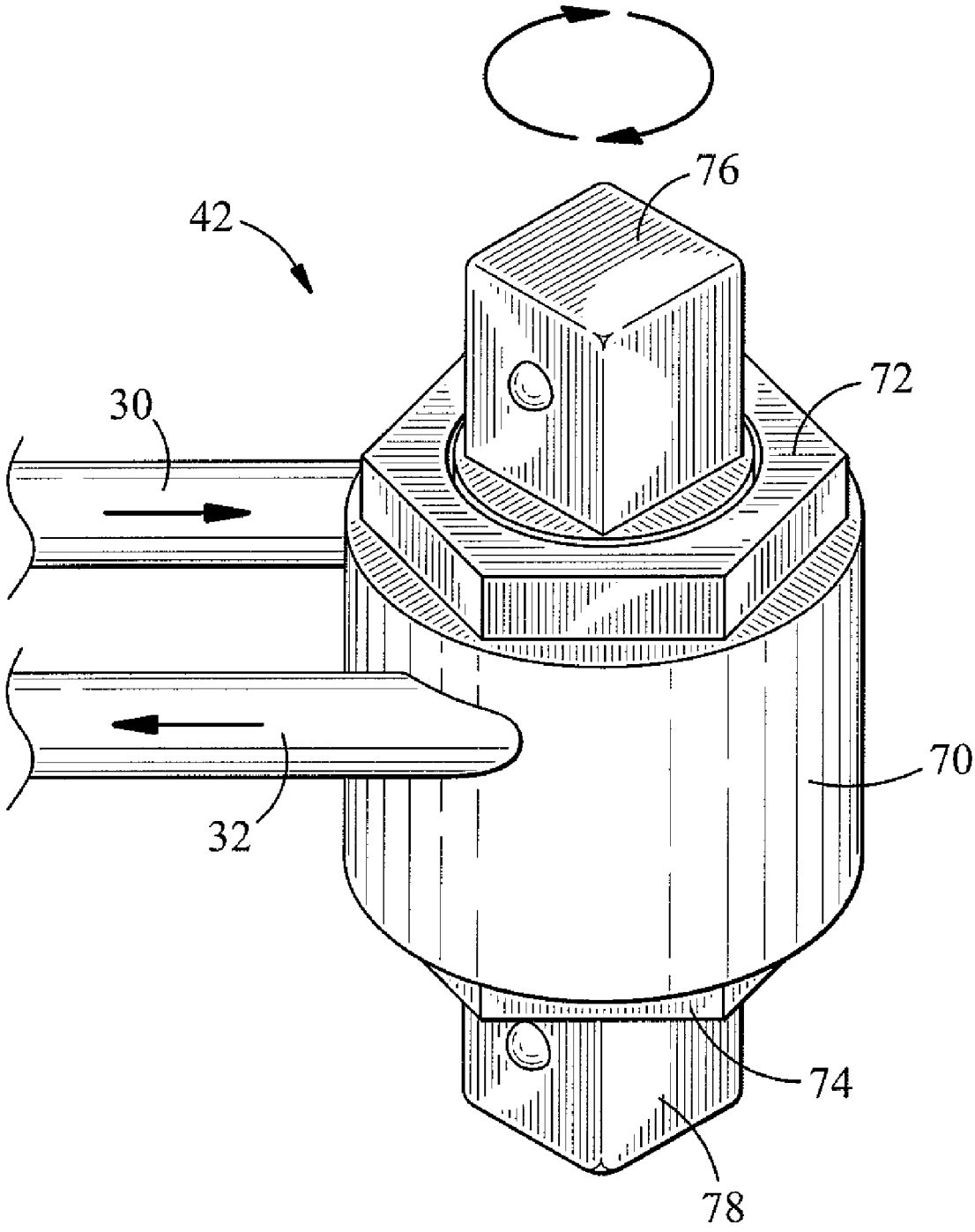
FIG. 5 is a view of the tool driving element of the hydraulically operated tool in accordance with another embodiment of the present invention.

Another embodiment of the tool driving element 42 is shown in FIG. 5. In this embodiment, the tool driving element comprises a main body 70 so that the reversing selector valve 50 is not needed in the embodiment. The main body 70 is cylindrically shaped. The hydraulic supply line 31 enters the main body 70 through an opening in the surface of the main body and the hydraulic return line 32 exits the main body 70 through a second opening located near the first opening. A first receiving/locking member 72 is attached to one end of the cylinder-shaped main body 70 while a second receiving/locking member 74 is attached to the opposite end of the cylinder-shaped main body 70 from the first receiving/locking member 72. Socket-type studs may be attached to the receiving/locking members 72 and 74 in a conventional fashion and can be in the form of a screw-driver bit, wrench bit drill bit or the like (not shown) In the embodiment shown in FIG. 5, a first socket stud 76 is shown as rotatably mating with the first receiving/locking member 72, whereas a second socket stud 78 is shown as rotatably mating with the second receiving/locking member 74. In this embodiment, the operator turns the cylinder-shaped main body 70 upside down to reverse the direction of the output being applied to the stud 76 or 78, since both studs 76 and 78 continually rotate by means of a driving system as shown in FIG. 2.

While the invention has been described in connection with the preferred embodiments described above, it is not intended to limit the scope of the invention to the particular form set forth, but on the contrary, it is intended to cover such alternatives, modifications, and equivalents as may be included within the spirit and scope of the invention as defined by the appended claims.

The invention claimed is:

1. A compact, hydraulically operated tool, comprising:

a tool driving element in the form of a rotary vane-type output assembly in which the movement of fluid through a fluid arc rotates a rotatable element attached thereto in a clockwise or counterclockwise direction;

a rod-like member having an interior portion, a front end and a rear end, wherein said front end is attached to said tool driving element, said rod-like member having channels within said interior portion to allow a supply and return flow of fluid to said tool driving element;

an actuating mechanism attached to said rear end of said tool driving element via a flexible supply line and a flexible return line;

said actuating mechanism having a fluid reservoir, and a pump-type actuator for providing the flow of fluid through said tool driving element, through said supply line and said return line, and through said channels within said rod-like member for providing a rotating force to said rotatable element; and wherein an operator can hold the rod-like member in one hand and the activating mechanism in another hand in order to use the tool driving element in a confined location while activating said actuating mechanism.

2. The hydraulically operated tool of claim 1, further comprising a pressure gauge connected to said actuating mechanism at a gauge connection point to enable an operator to monitor hydraulic pressure.

3. The hydraulically operated tool of claim 1, wherein the pump-type actuator is in the form of a pistol-grip, hand-powered pump.

4. The hydraulically operated tool of claim 1, wherein said supply line and said return line are mounted side by side.

5. The hydraulically operated tool of claim 4, in which said supply line and said return line are substantially between 24 and 48 inches in length.

6. The hydraulically operated tool of claim 1, in which said rotatable element receives a bit selected from the group essentially consisting of:

a socket wrench-type bit;

a screw driver-type bit; and a drill-type bit.

7. The hydraulically operated tool of claim 1, in which said tool driving element has a substantially cylindrical body having its interior connected to said channels within the rod-like member, said cylindrical body having another rotatable element oppositely disposed to said rotatable element, said rotatable elements rotatable in opposite directions.

8. A compact, hydraulically operated tool, comprising:

a tool driving element in the form of a rotary vane-type output assembly in which the movement of fluid through a fluid arc rotates an element attached thereto in a clockwise or counterclockwise direction;

a rod-like member having an interior portion, a front end and a rear end, wherein said front end is attached to said tool driving element, said rod-like member having channels within said interior portion to allow a supply and return flow of fluid to flow to said tool driving element;

an actuating mechanism attached to said rear end of said tool driving element via a flexible supply line and a flexible return line;

said actuating mechanism having a fluid reservoir, and a pump-type actuator for providing the flow of fluid through said tool driving element, through said supply line and said return line, and through said channels within the rod-like member for providing a rotating force to said rotatable element;

a valve operably connected to said supply line and said return line for changing the direction of flow of the fluid to enable the tool driving element to selectively rotate in either of two directions; and wherein an operator can hold the rod-like member in one hand and the activating mechanism in another hand in order to use the tool driving element in a confined location while activating said actuating mechanism.

9. A compact, hydraulically operated tool, comprising:

a tool driving element in the form of a rotary vane-type output assembly in which the movement of fluid through a fluid arc rotates an element attached thereto in a clockwise or counterclockwise direction;

a rod-like member having an interior portion, a front end and a rear end, wherein said front end is attached to said tool driving element, said rod-like member having channels within said interior portion to allow a supply and return flow of fluid to flow to said tool driving element;

an actuating mechanism attached to said rear end of said tool driving element via a flexible supply line and a flexible return line;

said actuating mechanism having a fluid reservoir, and a pump-type actuator for providing the flow of fluid through said tool driving element, through said supply line and said return line, and through said channels within the rod-like member for providing a rotating force to said rotatable element;

said tool driving element comprises a substantially cylindrical body having its interior connected to said channels within the rod-like member, said cylindrical body having a first receiving/locking member secured to one of its ends and a second receiving/locking member secured to the oppositely disposed end, said receiving/locking members being used for attaching socket-type studs or other attachments to either end of said cylindrical body;

the studs or attachments on the oppositely disposed sides of said cylindrical body are rotatable in opposite directions; and wherein an operator can hold the rod-like member in one hand and the activating mechanism in another hand in order to use the tool driving element in a confined location while activating said actuating mechanism.

* * * * *